US012366374B2

(12) United States Patent
Iuchi et al.

(10) Patent No.: US 12,366,374 B2
(45) Date of Patent: Jul. 22, 2025

(54) AIR CONDITIONER

(71) Applicant: Carrier Japan Corporation, Tokyo (JP)

(72) Inventors: Akira Iuchi, Fuji (JP); Ken Miura, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 165 days.

(21) Appl. No.: 18/185,637

(22) Filed: Mar. 17, 2023

(65) Prior Publication Data

US 2023/0221023 A1 Jul. 13, 2023

Related U.S. Application Data

(63) Continuation of application No. PCT/JP2020/035356, filed on Sep. 17, 2020.

(51) Int. Cl.
*F24F 11/32* (2018.01)
*F24F 11/86* (2018.01)

(52) U.S. Cl.
CPC ..... *F24F 11/32* (2018.01); *F24F 11/86* (2018.01)

(58) Field of Classification Search
CPC .. F24F 11/32; F24F 11/86; F24F 11/38; F24F 11/64; F24F 3/065
See application file for complete search history.

(56) References Cited

U.S. PATENT DOCUMENTS

2013/0282181 A1* 10/2013 Lu ..... F24F 11/30 700/275
2016/0161165 A1* 6/2016 Ushijima ..... F24F 11/63 62/155
2018/0191197 A1* 7/2018 Carr ..... G01R 11/56
2020/0018509 A1* 1/2020 Nagahara ..... F24F 11/54
2021/0003305 A1* 1/2021 Zhang ..... F24F 11/65
2022/0131776 A1* 4/2022 Matsumoto ..... H04L 41/0816
2023/0288076 A1* 9/2023 Ni ..... F24F 11/86

FOREIGN PATENT DOCUMENTS

CN 1798942 A * 7/2006 ..... F24F 1/08
CN 1952511 A 4/2007
CN 103307698 A 9/2013
(Continued)

OTHER PUBLICATIONS

PCT Search Report and Written Opinion mailed on Nov. 10, 2020, for PCT Application No. PCT/JP2020/035356, 17 pages.
(Continued)

*Primary Examiner* — Nelson J Nieves
(74) *Attorney, Agent, or Firm* — Lee & Hayes, P.C.

(57) ABSTRACT

According to one embodiment, an air conditioner with two or more outdoor units and one or more indoor units, which are connected to a single refrigerant pipe in parallel, the air conditioner comprising a controller configured to determine, based on driving performance of the two or more outdoor units, a driving priority order of the two or more outdoor units. The controller switches the driving priority order of the two or more outdoor units between a descending order of the driving performance of the outdoor units and an ascending order of the driving performance of the outdoor units at certain intervals.

10 Claims, 3 Drawing Sheets

(56) References Cited

FOREIGN PATENT DOCUMENTS

| | | | | | |
|---|---|---|---|---|---|
| CN | 104833047 | A | | 8/2015 | |
| CN | 207422557 | U | | 5/2018 | |
| EP | 1630484 | A1 | * | 3/2006 | ..... F24F 1/08 |
| JP | S511943 | U | | 1/1976 | |
| JP | H05010607 | A | | 1/1993 | |
| JP | H06249529 | A | | 9/1994 | |
| JP | H07293977 | A | | 11/1995 | |
| JP | 2003166740 | A | | 6/2003 | |
| JP | 2006275458 | A | | 10/2006 | |
| JP | 2011252617 | A | | 12/2011 | |
| JP | 2012181010 | A | | 9/2012 | |
| JP | 2013221623 | A | | 10/2013 | |
| JP | 2015141014 | A | * | 8/2015 | ..... F24F 11/30 |
| JP | 7031013 | B2 | * | 3/2022 | |
| KR | 1020070043416 | A | | 4/2007 | |
| KR | 20170137356 | A | * | 12/2017 | |
| WO | WO2017026054 | A1 | | 2/2017 | |
| WO | WO2020065731 | A1 | | 4/2020 | |
| WO | WO-2020066809 | A1 | * | 4/2020 | ..... F24F 11/52 |

OTHER PUBLICATIONS

Chinese Office Action mailed on May 31, 2024 for Chinese Patent Application No. 202080105249.2, a foreign counterpart of U.S. Appl. No. 18/185,637, 8 pages.

* cited by examiner

AIR CONDITIONER

CROSS-REFERENCE TO RELATED APPLICATIONS

This application is a Continuation Application of PCT Application No. PCT/JP2020/035356, filed Sep. 17, 2020, the entire contents of which are incorporated herein by reference.

FIELD

Embodiments described herein relate generally to an air conditioner.

BACKGROUND

For air conditioners in which a plurality of outdoor units are connected to a single refrigeration system, there is a known technique of performing a rotational control per outdoor unit for evening accumulated driving time of the outdoor units.

Note that, in the conventional technique, if there is one broken down among the multiple outdoor units, properly operable outdoor units would be continuously driven immediately after the breakdown for continuous drive of the system. However, in the continuous drive, the performance would become insufficient, and thus, air conditioning performance would be insufficient accordingly. Furthermore, if the all outdoor units of the air conditioner are stopped, and at the time when the air conditioner restarts the drive, the driving priority order of the broken outdoor unit is in a high rank, the performance would become insufficient, and furthermore, restart of the driving would be impossible. Furthermore, if the driving priority order of an outdoor unit which is abnormally stopped or detected with an abnormality is in a high rank, the outdoor unit in a bad condition would be frequently stopped, or the performance would become insufficient, and the air conditioning performance would be insufficient accordingly. In such a case, users would feel unpleasant.

The present application presents an air conditioner which can maintain the air conditioning performance even if an outdoor unit is broken down among a plurality of outdoor units.

DETAILED DESCRIPTION

Figure 1:
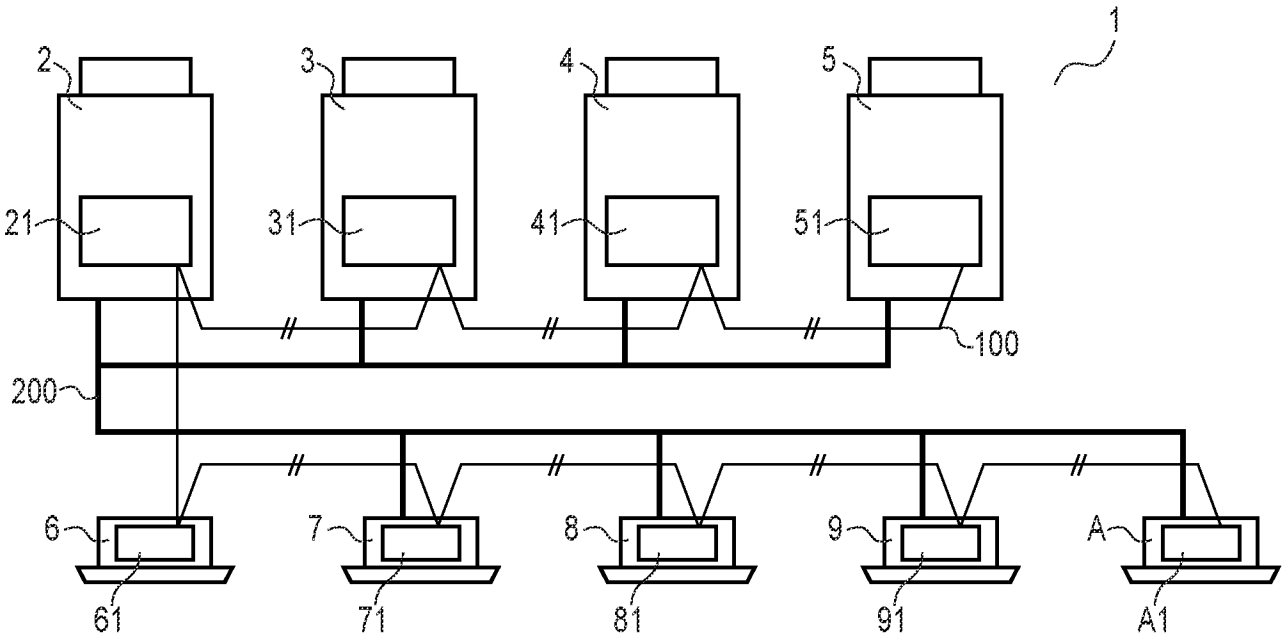
FIG. 1 is a schematic diagram illustrating an example of the entire structure of an air conditioner.

Embodiments will be described hereinafter with reference to the accompanying drawings. The disclosure here is made by way of example, and the description of the following embodiment will not limit the scope of the invention. Changes easily conceivable for a person having ordinary skill in the art would naturally be encompassed within the scope. Each figure is a schematic diagram for better understanding to the embodiments, and the sizes, shapes, etc. may differ from the actual devices. In the drawings, common elements will be referred to by the same reference numerals, and detailed description considered redundant will be omitted.

In general, according to one embodiment, an air conditioner with two or more outdoor units and one or more indoor units, which are connected to a single refrigerant pipe in parallel, the air conditioner comprising a controller configured to determine, based on driving performance of the two or more outdoor units, a driving priority order of the two or more outdoor units. The controller switches the driving priority order of the two or more outdoor units between a descending order of the driving performance of the outdoor units and an ascending order of the driving performance of the outdoor units at certain intervals.

First Embodiment

Hereinafter, an air conditioner of a first embodiment will be explained with reference to the accompanying drawings.

FIG. 1 is a schematic diagram illustrating an example of the entire structure of an air conditioner 1. Note that, FIG. 1 shows an example where the air conditioner 1 includes four outdoor units and five indoor units; however, the numbers of the outdoor and indoor units are not limited to the aforementioned example.

As in FIG. 1, the air conditioner 1 includes four outdoor units arranged in parallel, that is, outdoor units 2, 3, 4 and 5. Furthermore, the air conditioner 1 includes five indoor units arranged in parallel, that is, indoor units 6, 7, 8, 9, and A. The outdoor units 2, 3, 4, and 5 and the indoor units 6, 7, 8, 9, and A are connected through an electric line 100 and refrigerant pipe 200.

The outdoor units 2, 3, 4, and 5 each include, as main elements, a compressor with a sensor configured to detect an amount of oil, check valve, oil separator, four-way valve, heat exchanger, expansion valve, liquid tank, outdoor unit fan, accumulator, on-off valve, and sensor configured to detect a flow rate of refrigerant flowing to the refrigerant pipe 200, which are not shown.

The outdoor units 2, 3, 4, and 5 include controllers 21, 31, 41, and 51, respectively. Each of the controllers 21, 31, 41, and 51 each include a CPU, memory, storage device (non-volatile memory), input/output circuit, and timer in order to execute predetermined calculation processes. Furthermore, the controllers 21, 31, 41, and 51 are communicable with each other through the electric line 100, and information can be transferred/received therebetween. Note that, values detected by the sensors of the compressors of the outdoor units 2 to 5 and values detected by the sensors configured to detect the flow rate of refrigerant are output to the controllers 21, 31, 41, and 51, respectively.

Furthermore, the controller 21 of the outdoor unit 2 executes, based on communication information received from controllers 31, 41, and 51 of other outdoor units 3, 4, and 5, general control of the air conditioner 1 such as calculation of drive accumulation time, driving performance of each of the outdoor units 2 to 5, and change of driving priority order which will be described later. Note that, in the present embodiment, the controller 21 functions as the general controller; however, the general control may be executed by the controllers 31, 41, and 51. Furthermore, the general controller may be switched between the controllers 21, 31, 41, and 51 at certain intervals. Furthermore, the aforementioned general control may be executed by multiple controllers among the controllers 21, 31, 41, and 51.

The indoor units 6, 7, 8, 9, and A are each disposed inside buildings in order to adjust a temperature of air in the space where they are disposed.

The indoor units 6, 7, 8, 9, and A include controllers 61, 71, 81, 91, and A1, respectively. The controllers 61, 71, 81, 91, and A1 performs communication with the controllers of the outdoor units, especially the general controller 21 through the electric line 100.

Figure 2:
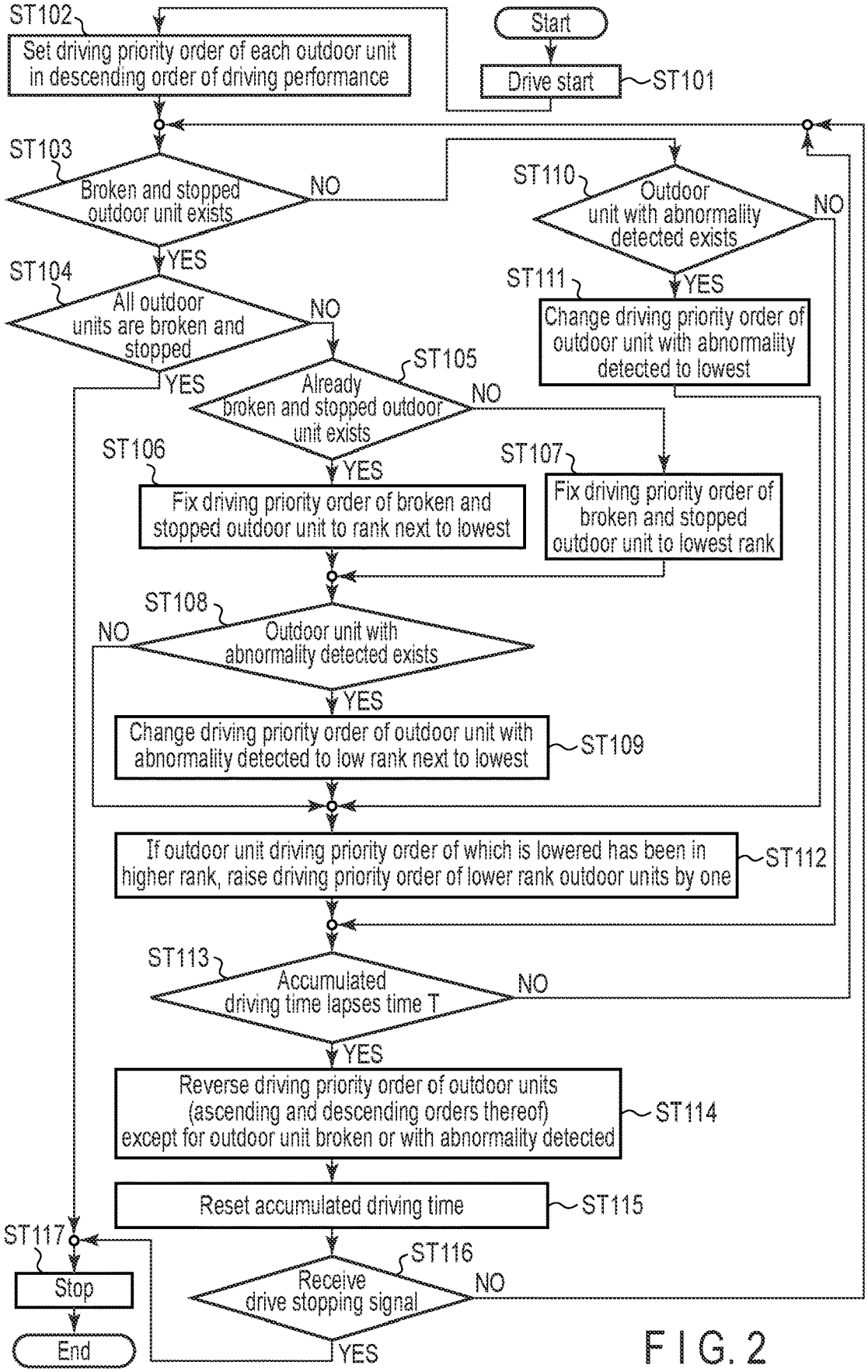
FIG. 2 is a flowchart of an example of control.

In the air conditioner 1 structured as above, the controller 21 selects and drives an outdoor unit to be operated from the outdoor units 2, 3, 4, and 5 based on a driving priority order in order to condition the indoor air where the indoor units 6 to 9, and A are disposed. FIG. 2 is a flowchart indicating an example of the control executed by the controller 21 of the air conditioner 1. In the present embodiment, the following process is realized by CPU executing programs stored in the memory of the controller 21; however, a circuit may be provided with the controller 21 such that the following process is realized by the circuit.

As in FIG. 2, the controller 21 starts the drive of the air conditioner 1 at a predetermined timing (ST101). For example, the drive of the air conditioner 1 is started at a predetermined time or at an instruction of drive start.

Then, the controller 21 sets the driving priority order of each of the outdoor units (outdoor units 2 to 5) in the descending order of the driving performance (ST102). For example, if the driving performances of the outdoor units 2 to 5 are outdoor unit 2>3>4>5, the driving priority order is set such that the outdoor unit 2 has priority order P1, outdoor unit 3 has priority order P2, outdoor unit 4 has priority order P3, and outdoor unit 5 has priority order P4. In the present embodiment, the priority of the priority order is P1>P2>P3>P4, where P1 is highest and P4 is lowest in the priority.

Then, the controller 21 determines whether or not there is an outdoor unit broken and stopped among the outdoor units 2 to 5 (ST103). The outdoor unit broken and stopped is an outdoor unit which is not operable and stopped. If it is determined that there is an outdoor unit broken and stopped (YES in ST103), the controller 21 determines if the outdoor units 2 to 5 are all broken and stopped (ST104). If it is determined that the outdoor units 2 to 5 are all broken and stopped (YES in ST104), the controller 21 stops driving (ST117) and ends the drive.

Furthermore, if it is determined that not all the outdoor units 2 to 5 are broken and stopped (NO in ST104), the controller 21 determines if there is an outdoor unit which has already been broken and stopped (ST105). If it is determined that there is an outdoor unit which has already been broken and stopped (YES in ST105), the controller 21 fixes the driving priority order of the broken and stopped outdoor unit to a low rank which is next to the lowest rank (ST106). For example, if it is currently determined that the outdoor unit 3 is broken and stopped while there has already been the broken and stopped outdoor unit 4, since the outdoor unit 4 is fixed to the priority order P4, the priority order of the outdoor unit 3 is fixed to P3 which is next to the lowest P4 (in other words, one above the lowest rank).

If it is determined that there is not an outdoor unit which has already been broken and stopped (NO in ST105), the controller 21 fixes the driving priority order of the broken and stopped outdoor unit to the lowest rank (ST107). For example, if it is currently determined that the outdoor unit 3 is broken and stopped while there is no outdoor unit which has already been broken and stopped, the priority order of the outdoor unit 3 is fixed to the lowest priority order P4.

After the process of step ST106 or the process of step ST107, the controller 21 determines whether or not there is an outdoor unit with abnormality detected (ST108). Abnormality of outdoor units indicates, for example, a case where oil of a compressor is insufficient or a case where a refrigerant flowing to the refrigerant pipe 200 is insufficient, and in such cases, the driving is possible but performance demanded may not possibly achievable. Such abnormality can be detected based on information received by the controller 21 from the other controller 31 to 51 through the electric line 100. If it is determined that there is an outdoor unit with abnormality detected (YES in ST108), the controller 21 changes the driving priority order of the outdoor unit with abnormality detected to a low rank which is next to the lowest rank. For example, if the outdoor unit 3 has already been broken and stopped, and is currently fixed to the priority order P4, and then abnormality is detected in the outdoor unit 5, the driving priority order of the outdoor unit 5 is changed to the priority order P3.

If the process of step ST109 ends, or if it is determined that there is not an outdoor unit with abnormality detected in step ST108 (NO in ST108), the controller 21 raises the driving priority order of a low rank outdoor unit one above if the outdoor unit of which driving priority order is lowered has been in a higher rank (ST112). For example, if the setting of the driving priority order is set such that the outdoor unit 2 has priority order P1, outdoor unit 3 has priority order P2, outdoor unit 4 has priority order P3, and outdoor unit 5 has priority order P4, and the outdoor unit 3 is broken and stopped, the driving priority order of the outdoor unit 3 is fixed to the priority order P4 while raising the driving priority orders of the outdoor units 4 and 5 which are in the lower ranks than the outdoor unit 3 to P2 and P3 which are one rank above, respectively. Furthermore, the driving priority order of the outdoor unit 2 which is above that of the outdoor unit 3 is not changed from P1.

On the other hand, if it is determined that there is not an outdoor unit broken and stopped (NO in ST103), the controller 21 determines if there is an outdoor unit with abnormality detected (ST110). An outdoor unit with abnormality detected is an outdoor unit stopped because of receiving drive stopping signals as in aforementioned cases where oil of compressor is insufficient and where refrigerant flowing to the refrigerant pipe 200 is insufficient, and because of a reason other than proper stop such as thermos-off stop. If it is determined that there is an outdoor unit with abnormality detected (YES in ST110), the controller 21 changes the driving priority order of the outdoor unit to the low rank next to the lowest rank (ST111). For example if it is currently determined that the outdoor unit 3 is with abnormality detected while there has not been a broken and stopped outdoor unit, the priority order of the outdoor unit 3 is fixed to the lowest priority order P4, and while there has already been a broken and stopped outdoor unit, the priority order thereof is fixed to the priority order P3 which is next to the lowest rank.

If the process of step ST112 ends as above, or if it is determined that there is not an outdoor unit with abnormality detected in the process of step ST110 (NO in ST110), the controller 21 determines whether or not an accumulated driving time has lapsed a time T (ST113). Here, the time T is a regulation time regulated in advance, and for example, the time T is regulated as 30 hours. If it is determined that the accumulated driving time has lapsed the time T (YES in ST113), the controller 21 reverse the driving priority order (the ascending order and descending order thereof) except for the outdoor unit broken and stopped or with abnormality detected (ST114). For example, if there is not an outdoor unit broken and stopped or an outdoor unit stopped with abnormality, and the outdoor unit 2 has priority order P1, outdoor unit 3 has priority order P2, outdoor unit 4 has priority order P3, and outdoor unit 5 has priority order P4, the driving priority order is then changed such that outdoor unit 2 has priority order P4, outdoor unit 3 has priority order P3, outdoor unit 4 has priority order P2, and outdoor unit 5 has priority order P1. Furthermore, if the outdoor unit 5 is broken and stopped, since the outdoor unit 5 is fixed to priority order P4, it is excluded from the change of the driving priority order, and if the outdoor unit 2 has priority order P1, outdoor unit 3 has priority order P2, and outdoor unit 4 has priority order P3, the driving priority order is then changed such that the outdoor unit 2 has priority order P3, outdoor unit 3 has priority order P2, and outdoor unit 4 has priority order P1. Note that of the controller 21 determines that the accumulated driving time has not lapsed the time T (NO in ST113), the process returns to step ST103.

After the process of step ST114, the controller 21 resets the accumulated driving time (ST115). Then, the controller 21 determines whether or not a drive stopping signal is received (ST116). The drive stopping signal is sent to the controller 21 based on a certain time or an instruction of drive stop. If it is determined that the drive stopping signal is received (YES in ST116), the controller 21 stops the drive of the air conditioner 1 (ST117), and ends the drive. On the other hand, if the controller 21 determines that the drive stopping signal is not received (NO in ST116), the process returns to step ST103.

As above, the controller 21 reverses the driving priority order corresponding to the performances of the outdoor units except for an outdoor unit broken and stopped or for an outdoor unit broken and stopped and an outdoor unit with abnormality detected, every time when the accumulated driving time lapses the time T (that is, at certain intervals) in order to even the driving time of the outdoor units 2 to 5. Furthermore, because the controller 21 fixes the driving priority order of the broken and stopped outdoor unit to the lowest rank, the air conditioner 1 can perform the normal drive through the other outdoor units in response to the demands of users, and thus, the air conditioning can be performed without causing inconvenience to the users. Furthermore, the controller 21 sets the outdoor unit with abnormality detected to the lowest rank or to a rank one above the lowest rank, and thus, the driving frequency of the outdoor unit with abnormality detected can be lowered. Therefore, the air conditioner 1 suppresses a possibility that the outdoor unit with abnormality detected would be stopped, and the air conditioning can be performed without causing inconvenience to the users.

Second Embodiment

The present embodiment is structured such that the driving priority order of outdoor units included in the air conditioner 1 is changed, and in this respect, it is different from the first embodiment. Thus, a process of changing the setting of the driving priority order will be mainly explained. Note that, the same structures as in the first embodiment will be referred to by the same reference numbers, and detailed description thereof will be omitted.

Figure 3:
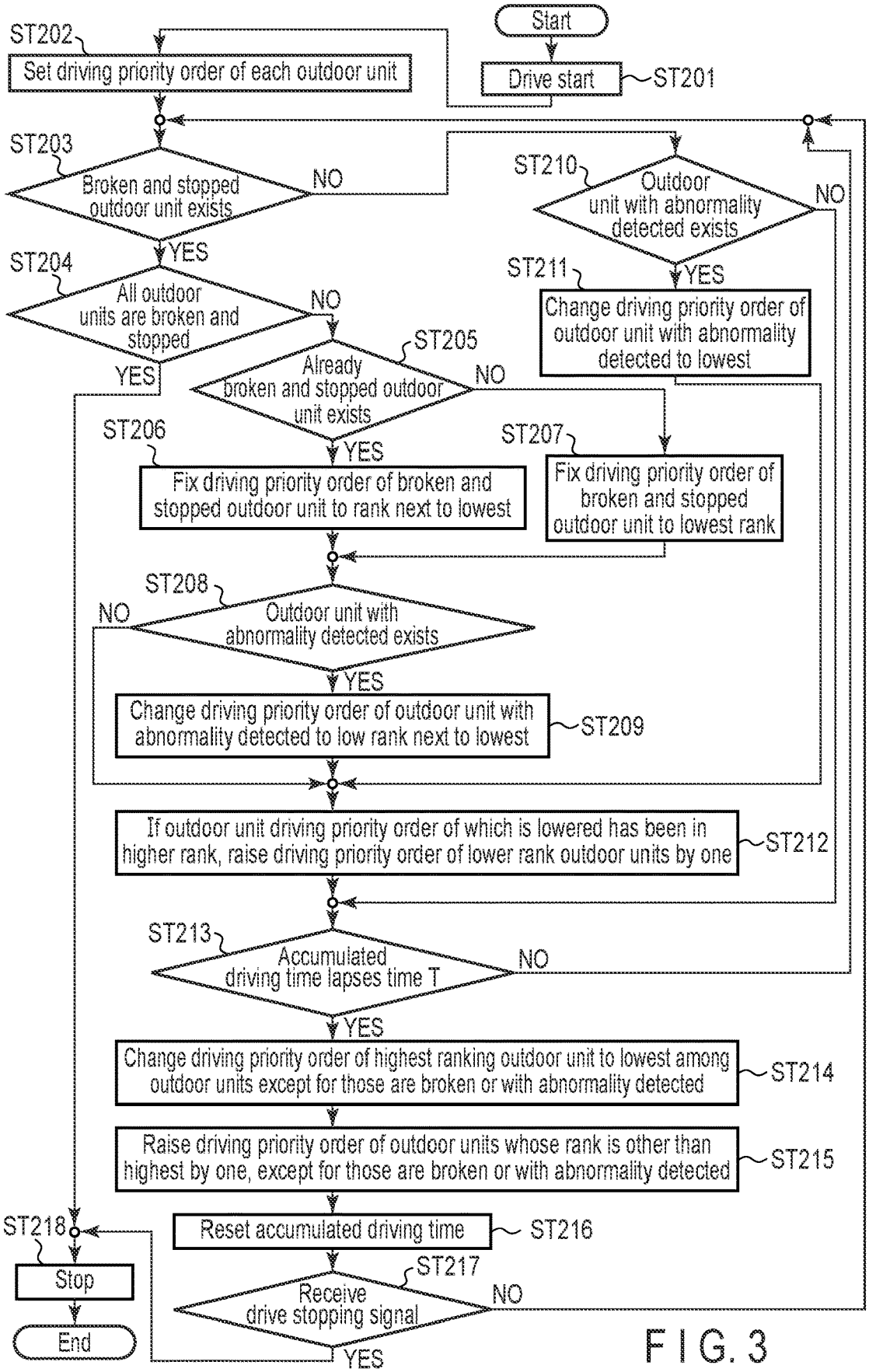
FIG. 3 is a flowchart of an example of control.

FIG. 3 is a flowchart of an example of the control executed by the controller 21 of the air conditioner 1.

As in FIG. 3, the controller 21 starts the drive of the air conditioner 1 at a certain timing (ST201). For example, the drive of the air conditioner 1 is started at a certain time or by an instruction of drive start as with the aforementioned process of step ST101.

Then, the controller 21 sets the driving priority order of each of the outdoor units (outdoor units 2 to 5) (ST202). For example, the controller 21 sets the priority order of outdoor unit 2 to P1, outdoor unit 3 to P2, outdoor unit 4 to P3, and outdoor unit 5 to P4.

Then, the controller 21 executes processes of steps ST203 to ST213. The processes of steps ST203 to ST213 are similar to the aforementioned steps ST103 to ST113, respectively (cf. FIG. 2). Therefore, explanation of the processes of steps ST203 to ST213 will be omitted.

In step ST213, if it is determined that the accumulated driving time has lapsed a time T (YES in ST213), the controller 21 the driving priority order of the highest ranking outdoor unit to the lowest rank among the outdoor units without any breakdown or abnormality (ST214). After the process of step ST214, the controller 21 raises the driving priority order of each of the outdoor units without any breakdown or abnormality, whose rank is other than the highest by one (ST215).

For example, if the outdoor unit 3 is broken and stopped, and the driving priority order is set such that the outdoor unit 2 has priority order P1, outdoor unit 3 has P4, outdoor unit 4 has P2, and outdoor unit 5 has P3, the driving priority order of outdoor unit 2 which is currently highest is set to P3 which is lowest among the outdoor units without any breakdown. Furthermore, the outdoor unit 4 has P1 from P2, and outdoor unit 5 has P2 from P3, since the priority order has been raised by one. As can be understood from the above, the priority order of the outdoor units 2, 4, and 5 is changed excluding the priority order P4 of the outdoor unit 3.

Then, the controller 21 resets the accumulated driving time (ST216), determines whether or not a drive stopping signal is received (ST217), and if the drive stopping signal is received (YES in ST217), stops the drive of the air conditioner 1 (ST218) to end the process, and if the drive stopping signal is not received, returns to the process of step ST203, as in the first embodiment.

As explained above, the controller 21 changes the driving priority order of the outdoor units except for the outdoor unit broken and stopped or the outdoor unit broken and stopped or the outdoor unit with abnormality detected. Therefore, the air conditioner 1 can perform the normal drive through the other outdoor units, and the air conditioning can be performed without causing inconvenience to users.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioner with two or more outdoor units and one or more indoor units, which are connected to a single refrigerant pipe in parallel, the air conditioner comprising a controller configured to determine, based on driving performance of the two or more outdoor units, a driving priority order of the two or more outdoor units, wherein the controller switches the driving priority order of the two or more outdoor units between a descending order of the driving performance of the outdoor units and an ascending order of the driving performance of the outdoor units at certain intervals.

2. The air conditioner of claim 1, wherein the controller fixes, if an outdoor unit stopped by a breakdown exists in the two or more outdoor units, the driving priority order of the stopped outdoor unit to a lowest rank.

3. The air conditioner of claim 2, wherein the controller sets, if an abnormality occurred in an outdoor unit other than the outdoor unit fixed to the lowest rank of the driving priority order, the driving priority order of the outdoor unit with the abnormality to one rank above the lowest rank.

4. The air conditioner of claim 1, wherein the controller sets the driving priority order of an outdoor unit stopped because of an abnormality to a lowest rank.

5. The air conditioner of claim 4, wherein the controller fixes, if an outdoor unit other than the outdoor unit stopped because of the abnormality is stopped by a breakdown, the driving priority order of the outdoor unit stopped by the breakdown to the lowest rank and raises the driving priority order of the outdoor unit stopped because of the abnormality to one above the lowest rank.

6. The air conditioner of claim 3, wherein the outdoor units each includes a compressor, and the controller detects, if an oil of any one of the compressors is insufficient, an abnormality of the outdoor unit including the compressor with the insufficient oil.

7. The air conditioner of claim 3, wherein the controller detects an abnormality of the outdoor units if a refrigerant flowing through the refrigerant pipe is insufficient, and if any one of the outdoor units with a compressor includes a refrigerant amount which is equal to or less than a predetermined value.

8. The air conditioner of claim 2, wherein the controller determines the driving priority order excluding the outdoor unit stopped by the breakdown and having the lowest rank in the driving priority order.

9. The air conditioner of claim 3, wherein the controller determines the driving priority order excluding the outdoor unit stopped by the breakdown and having the lowest rank in the driving priority order and the outdoor unit stopped by the abnormality and priority of which is one above the lowest rank.

10. The air conditioner of claim 1, wherein the controller switches the driving priority order after drive of the air conditioner starts and a predetermined accumulated driving time passes.

* * * * *